US007564422B1

(12) United States Patent
Diez et al.

(10) Patent No.: US 7,564,422 B1
(45) Date of Patent: Jul. 21, 2009

(54) PRESS FIT CORRUGATED RADIOMETER HORN

(75) Inventors: Jacob A. Diez, Orlando, FL (US); Charles D. Guth, Cocoa, FL (US); Richard A. Kirchofer, Cocoa, FL (US); Guy E. Maness, Yalaha, FL (US); Michael E. Weinstein, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 19 days.

(21) Appl. No.: 12/037,551

(22) Filed: Feb. 26, 2008

(51) Int. Cl.
*H01Q 13/00* (2006.01)

(52) U.S. Cl. ..... 343/786; 343/772; 343/776

(58) Field of Classification Search ..... 343/772, 343/776, 780, 784, 786
See application file for complete search history.

(56) References Cited

U.S. PATENT DOCUMENTS

| | | | | | |
|---|---|---|---|---|---|
| 3,924,237 | A * | 12/1975 | Fletcher et al. | ..... | 343/786 |
| 4,439,748 | A * | 3/1984 | Dragone | ..... | 333/239 |
| 4,477,816 | A * | 10/1984 | Cho | ..... | 343/786 |
| 2002/0060640 | A1 * | 5/2002 | Davis et al. | ..... | 342/104 |

* cited by examiner

*Primary Examiner*—HoangAnh T Le
(74) *Attorney, Agent, or Firm*—Jeffrey D. Myers; Peacock Myers, P.C.; Timothy D. Stanley

(57) ABSTRACT

A radiometer horn, an array of such horns, and a method of making a radiometer horn, comprising providing at least two primary walls comprising interior corrugations and fitting into the corrugations at least one secondary wall comprising projections fitting into the corrugations, and wherein no fastener holds any of the at least one secondary walls to the primary walls.

18 Claims, 4 Drawing Sheets

PRESS FIT CORRUGATED RADIOMETER HORN

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to radiometer horns and methods of manufacturing same.

2. Description of Related Art

It is necessary to package an array of corrugated (W-Band) Radiometer Horns in a tight grouping in order to achieve desired sensor performance for certain applications. A tight array leaves little additional volume around each horn, while the corrugated design of the horn creates a manufacturing challenge. Traditional manufacturing methods do not work due to the limited allowable volume for the horn (protruding fasteners interfere with the neighboring horn). The corrugated shape of these horns, as well as being of a small (W-Band) design, limits the potential to cast or electro-form this shape. The horns have to be built while ensuring complete electrical conductivity throughout the interior face of the horn, with minimal room for fasteners.

Similar (typically larger than W-Band) horns have been built with corrugated interior geometry, but the assembly methods employed do not yield a horn whose exterior volume is as small relative to the interior volume. The individual components that would be used to make other corrugated horns would not be press fit together. Instead, they would use multiple fasteners to ensure a tight press between each part. Often, these horns would then be dip braised to ensure a high degree of electrical conductivity.

Other horns have been manufactured with aluminum or other material, and then plated with gold or other highly conductive materials, to create the desired conductivity throughout the horns interior. This plating process would fail to evenly coat the small corrugations of our horns due to the flow of electrons in this geometry during the plating operation. For the same reasons, electro-forming methods could not be employed for a horn of this geometry and size.

The horns of the invention take advantage of a unique manufacturing method, known as Wire EDM (Electrical Discharge Machining), along with the corrugated shape, to create a press fit between the pieces of the horn. This press fit requires a highly precise manufacturing method to create three pieces that press together in such a way that electrical conductivity is maintained throughout the horn, yet the pieces do not bind or deform and fail to assemble correctly. The invention creates a highly effective W-band corrugated horn in a smaller volume, with fewer machining hours, for fewer resources than other methods. This allows for a better packaging environment to create a tight array of horns.

BRIEF SUMMARY OF THE INVENTION

The present invention is of a radiometer horn, an array of such horns, and a method of making a radiometer horn, comprising: providing at least two primary walls comprising interior corrugations; and fitting into the corrugations at least one secondary wall comprising projections fitting into the corrugations; and wherein no fastener holds any of the at least one secondary walls to the primary walls. In the preferred embodiment, all of the walls are wire electrical discharge machined, most preferably wherein the corrugations and the projections match within approximately 0.001 inches. All of the walls are copper, most preferably oxygen-free copper. The reflection coefficient of the radiometer horn is less than approximately 25 dB. The voltage standing wave ratio of the radiometer horn is less than approximately 1.1.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a W-Band Radiometer Horn that meets the critical requirements of assembly by utilizing a feature that enhances the horn's performance. Interior corrugations and a high-precision manufacturing method allow this horn to be miniaturized and manufactured relatively easily. This allows for a tightly packaged array of horns, opening up the potential opportunity for a radiometer sensor to be packaged into a smaller volume.

A radiometer is a device used to measure the radiant flux or power in electromagnetic radiation. Although the term is perhaps most generally applied to a device which measures infrared radiation, it can also be applied to detectors operating any wavelength in the electromagnetic spectrum. Radiometer Sensors have not been utilized as sensors in certain applications (such as for cruise missiles) due to the large volume requirements of these sensors. One aspect of the large volume requirements is the horn components. Corrugations on the interior of the horn can be utilized to enhance the performance of the horn. This allows for the horn's volume to be reduced. The reduction in size, for the W-band class of horn, creates new challenges in manufacturing.

The horns of the invention take advantage of a unique manufacturing method, known as Wire EDM (Electrical Discharge Machining), along with the corrugated shape of the horn, to create a press fit between the pieces of the horn. This press fit requires a highly precise manufacturing method to create three pieces that press together in such a way that electrical conductivity is maintained throughout the horn, yet the pieces do not bind, deform, or fail to assemble correctly.

Wire EDM is a method to cut conductive materials with a thin electrode that follows a programmed path. The electrode is a thin wire. Typical wire diameters range from 0.004"-0.012" although smaller and larger diameters are available. The hardness of the work piece material has no detrimental effect on the cutting speed. There is no physical contact between the wire and the part being machined, rather, the wire is charged to a voltage very rapidly. This wire is surrounded by deionized water. When the voltage reaches the correct level, a spark jumps the gap and melts a small portion of the work piece. The deionized water cools and flushes away the small particles from the gap. Wire EDM can be accurate to +/−0.0001", with no burrs generated.

Figure 1:
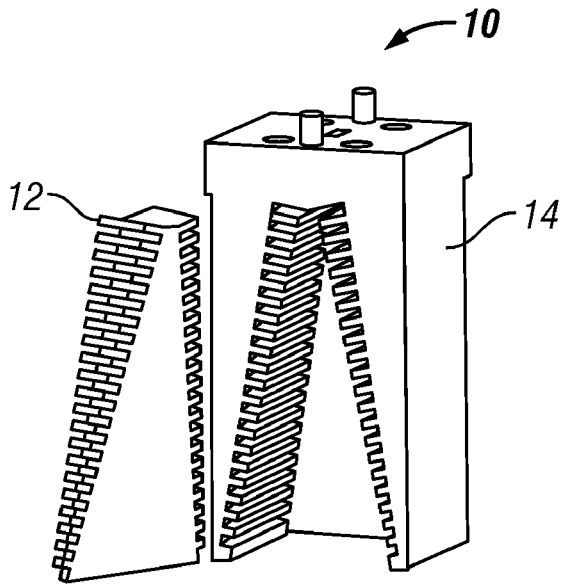
FIG. 1 is a front perspective view of the horn of the invention prior to press fitting of the two major components.
Figure 2:
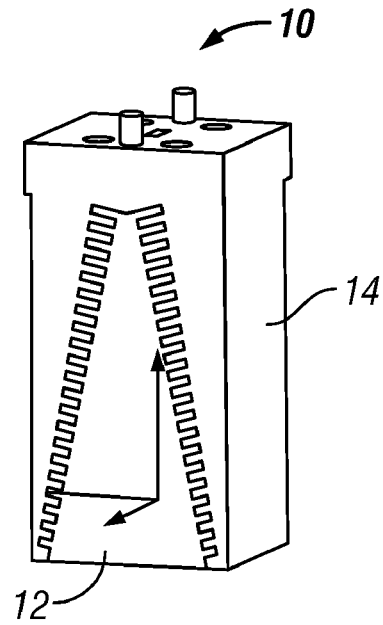
FIG. 2 is a front perspective view of the horn of the invention after press fitting.
Figure 3:
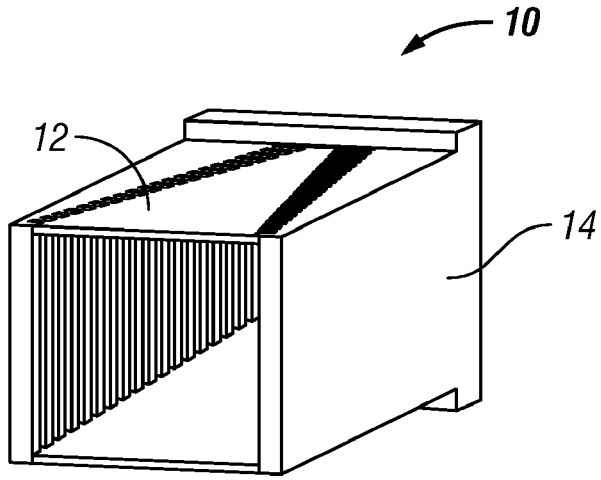
FIG. 3 is a top perspective view of the horn of the invention after press fitting.
Figure 4:
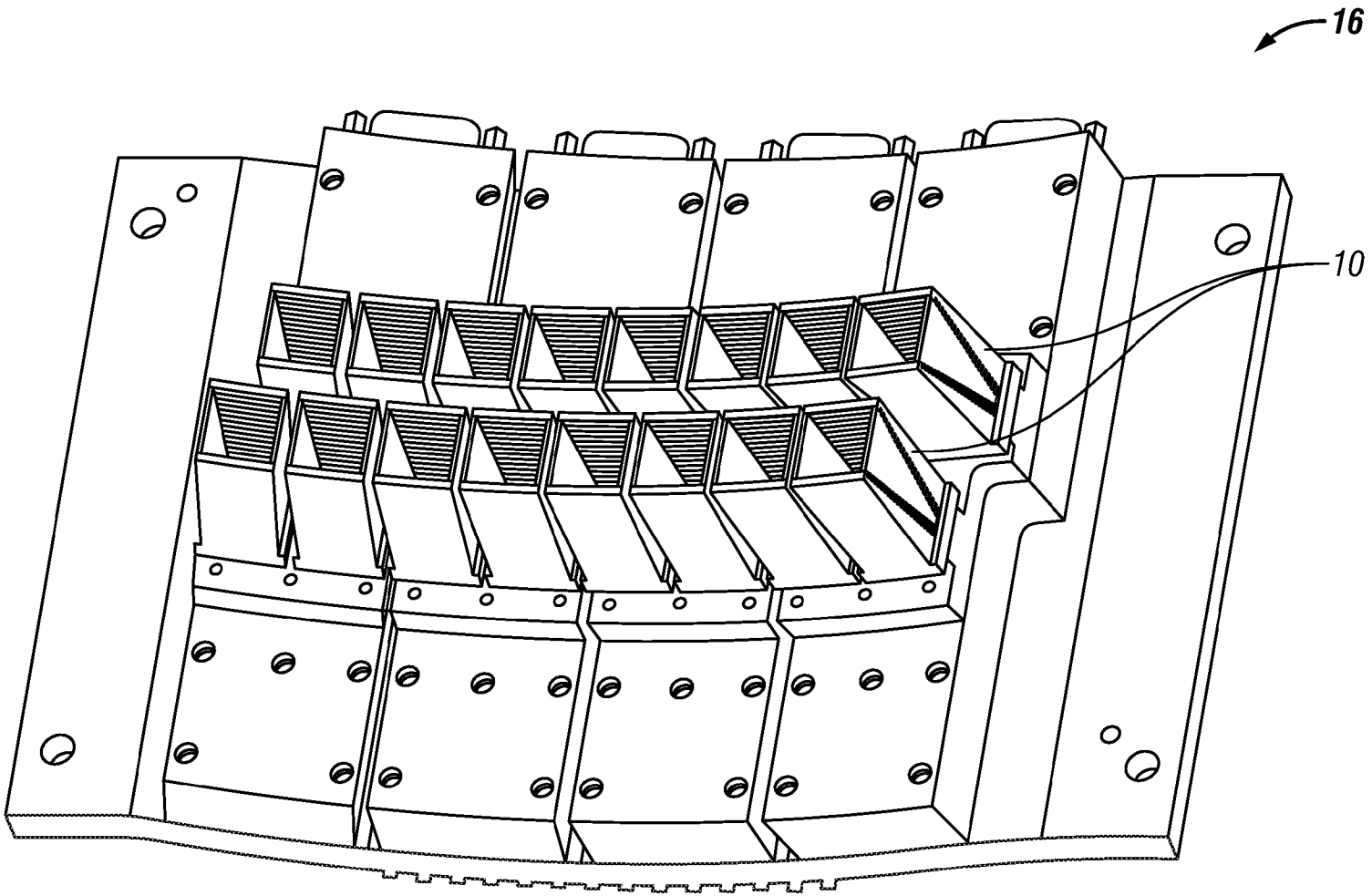
FIG. 4 is a top perspective view of an array of horns according to the invention.
Figure 5:
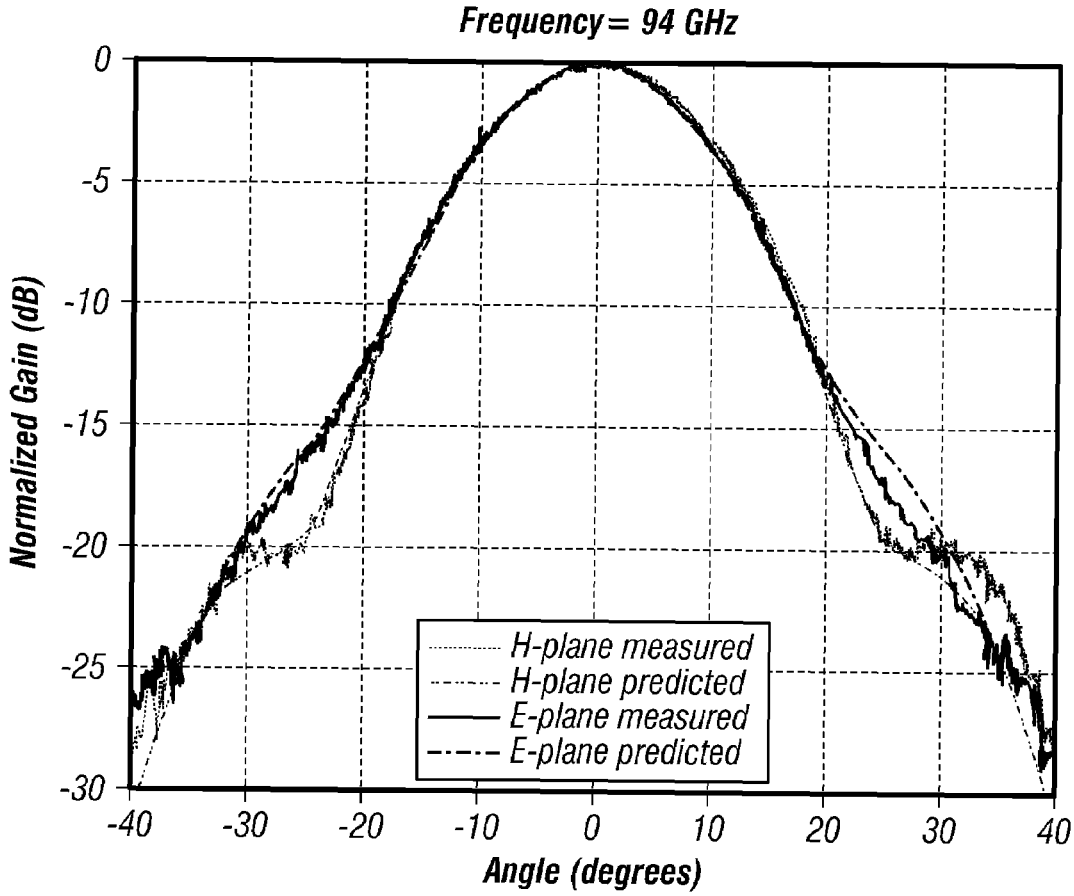
FIG. 5 is a graph of radiation patterns produced by a horn of the invention operating at 94 GHz (versus predicted values)
Figure 6:
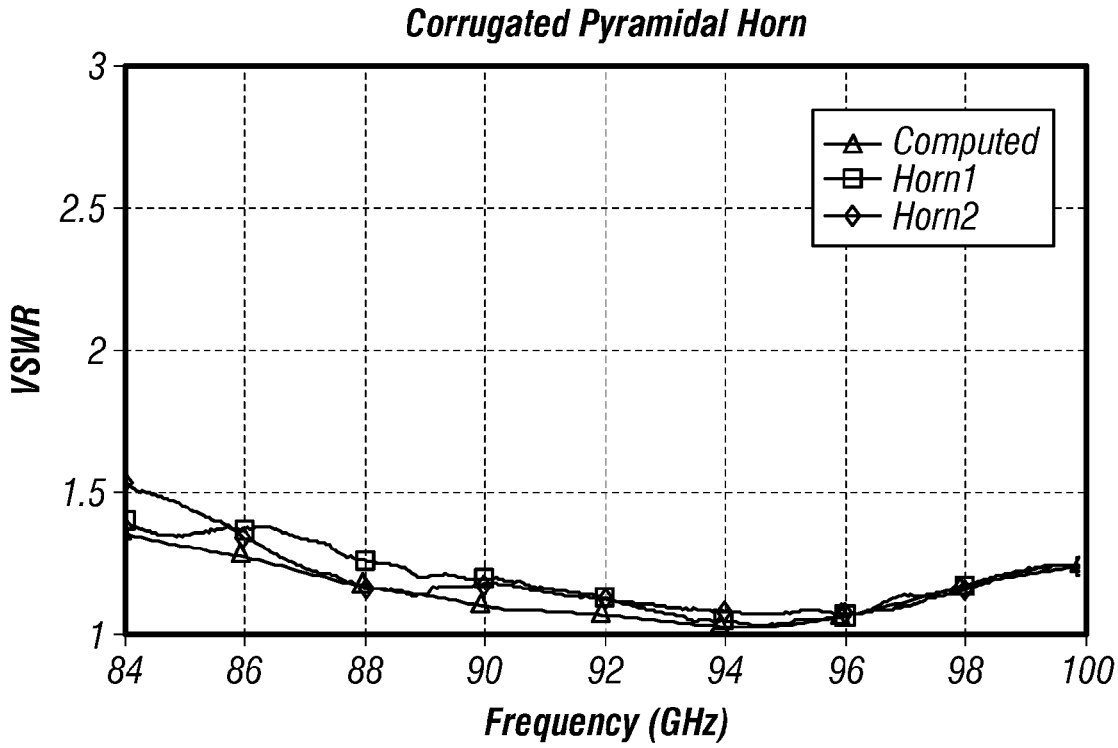
FIG. 6 is a graph of voltage standing wave ratio (VSWR) of horns of the invention (versus predicted values) at a range of frequencies.

FIGS. 1-3 illustrate the preferred horn 10 of the invention both before press fitting of the major components 12,14 and after. FIG. 4 illustrates employment of the invention in a tight-fitting array 16 of horns. FIG. 5 shows the radiation patterns produced by a horn of the invention operating at 94 GHz (versus predicted values). FIG. 6 shows the voltage standing wave ratio (VSWR) of horns of the invention (versus predicted values) at a range of frequencies.

The material from which the horns are fabricated is preferably copper, most preferably an oxygen-free copper. Each horn preferably performs such that its VSWR has a value less than 1.1 and such that the reflection coefficient is less than 25 dB.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A radiometer horn comprising:

at least two primary walls comprising interior corrugations; and at least one secondary wall comprising projections fitting into said corrugations; and wherein no fastener holds any of said at least one secondary walls to said primary walls.

2. The radiometer horn of claim 1 wherein all of said walls are wire electrical discharge machined.

3. The radiometer horn of claim 2 wherein said corrugations and said projections match within approximately 0.001 inches.

4. The radiometer horn of claim 1 wherein all of said walls are copper.

5. The radiometer horn of claim 4 wherein all of said walls are oxygen-free copper.

6. The radiometer horn of claim 1 wherein the reflection coefficient of said radiometer horn is less than approximately 25 dB.

7. The radiometer horn of claim 1 wherein the voltage standing wave ratio of said radiometer horn is less than approximately 1.1.

8. A radiometer horn array comprising a plurality of radiometer horns each comprising:

at least two primary walls comprising interior corrugations; and at least one secondary wall comprising projections fitting into said corrugations; and wherein no fastener holds any of said at least one secondary walls to said primary walls.

9. The radiometer horn array of claim 8 wherein all of said walls are wire electrical discharge machined.

10. The radiometer horn array of claim 8 wherein the reflection coefficient of all of said radiometer horns is less than approximately 25 dB and the voltage standing wave ratio of all of said radiometer horns is less than approximately 1.1.

11. A method of making a radiometer horn, the method comprising the steps of:

providing at least two primary walls comprising interior corrugations; and fitting into the corrugations at least one secondary wall comprising projections fitting into the corrugations; and wherein no fastener holds any of the at least one secondary walls to the primary walls.

12. The method of claim 11 wherein all of the walls are wire electrical discharge machined.

13. The method of claim 12 wherein the corrugations and the projections match within approximately 0.001 inches.

14. The method of claim 11 wherein all of the walls are copper.

15. The method of claim 14 wherein all of the walls are oxygen-free copper.

16. The method of claim 11 wherein the reflection coefficient of the radiometer horn is less than approximately 25 dB.

17. The method of claim 11 wherein the voltage standing wave ratio of the radiometer horn is less than approximately 1.1.

18. The method of claim 11 additionally comprising the step of forming a plurality of horns so made into an array.

* * * * *